United States Patent [19]

Drzewiecki

[11] 4,003,295

[45] Jan. 18, 1977

[54] FLUIDIC CAPACITOR FOR TEMPERATURE INDEPENDENT RC TIME CONSTANTS IN LIQUIDS

[75] Inventor: Tadeusz M. Drzewiecki, Silver Spring, Md.

[73] Assignee: The United States of America as represented by the Secretary of the Army, Washington, D.C.

[22] Filed: Apr. 10, 1975

[21] Appl. No.: 566,850

[52] U.S. Cl. ..... 92/1; 137/829

[51] Int. Cl.[2] ..... F15C 3/00

[58] Field of Search ..... 92/1, 131, 130 B; 137/829

[56] References Cited

UNITED STATES PATENTS 3,333,472 8/1967 McLellan ..... 92/1

*Primary Examiner*—William R. Cline

*Attorney, Agent, or Firm*—Nathan Edelberg; Robert P. Gibson; Saul Elbaum

[57] ABSTRACT

A fluid capacitor for liquid use is described comprising a cylinder-piston/spring arrangement where the spring constant is made to vary as the viscosity of a fluid, so that a temperature independent RC time constant can be achieved in the systems forced to operate at constant Reynolds number. In one embodiment of the invention a piston containing chamber is allowed to fill with fluid. The pressure of fluid on the movable piston is transmitted in the form of a normal force acting upon a beam which is rigidly supported at both ends, the beam consisting of a flexible material having a high thermal expansion coefficient and being supported by a rigid frame having a low thermal expansion coefficient such that the deflection of the beam is a function of both temperature as well as the applied force.

9 Claims, 2 Drawing Figures

FLUIDIC CAPACITOR FOR TEMPERATURE INDEPENDENT RC TIME CONSTANTS IN LIQUIDS

RIGHTS OF THE GOVERNMENT

The invention described herein may be manufactured, used, and licensed by or for the United States Government for governmental purposes without the payment to me of any royalty thereon.

BACKGROUND OF THE INVENTION

This invention relates to fluidic capacitors generally, and more particularly to a fluidic capacitor designed for liquid use wherein the spring constant is made to vary as the viscosity of the fluid such that a temperature independent RC time constant can be achieved in systems forced to operate at constant Reynolds number.

In systems using active and passive fluidic circuits, particularly those operating with liquids, one severe limitation is that of the temperature dependence of the components. Recently a system has been proposed that will regulate the power supply such that all elements would operate at a constant Reynolds number. This system holds all active devices to a constant gain, and makes the values of all resistances relative to the amplifier's supply resistance constant. However, when considering the dynamic response of such systems, it is found that RC time constants are still a function of temperature through viscosity. Hence, if a capacitor can be found to depend on the inverse of viscosity, the time constant would then remain constant. This invention describes one particular way, of a general scheme, for providing such a capacitance.

It is, therefore, a primary object of this invention to provide a fluidic capacitor for liquid use that will depend on the inverse of viscosity.

A more specific object of the invention is to provide a fluidic capacitor for liquid use such that when used in an RC circuit would provide an RC time constant that would remain constant.

These and other objects of the invention will become more readily apparent with respect to the appended claims and to the detailed description of the invention and drawings in which:

SUMMARY OF THE INVENTION

Briefly, in accordance with this invention, a fluidic capacitor is provided which depends on the inverse of viscosity so as to provide an RC time constant which is independent of temperature. In one embodiment the capacitor comprises a chamber having a movable piston as one wall thereof and a flexible beam connected to the chamber by a rigid rod. The flexible beam is supported at both ends by a rigid frame and pressure is exerted thereon by the action of the rigid rod which transmits forces acting upon the piston within the chamber. Because the flexible beam comprises a high thermal expansion material and the rigid frame comprises a low thermal expansion material, the deflection of the beam becomes a function of both temperature as well as applied force, thereby providing a variable capacitance chamber which is a function that depends on the inverse of viscosity.

DETAILED DESCRIPTION OF THE INVENTION

The value of resistance R in a fluidic circuit is $$R = k \cdot \mu$$

where $k$ is a constant of proportionality and $\mu$ is viscosity. The value of amplifier supply resistance is $$R_s = \frac{N_R\,\mu}{2\,c_d b_s^2 h}$$

where $N_R$ is Reynolds No., $c_d$ is nozzle discharge coefficient, $b_s$ is nozzle width and $h$ is nozzle height. The relative value of R to $R_s$ is then constant with temperature if $N_R$ is constant since $\mu$ cancells out.

$$\frac{R}{R_s} = \frac{2kc_d b_s^2 h}{N_R} = \text{constant}$$

The value however of the time constant in a passive line is RC. Since the capacitance C for a typical spring loaded piston/cylinder capacitor is virtually temperature independent $$c = A^2/K$$

where $A$ = piston area, $K$ = spring constant the time constant will vary as does $\mu$ $$RC = \frac{kA^2}{K} \cdot \mu$$

If the spring constant, however also varies as $\mu$ then RC will be constant.

A temperature dependent spring can be generated by considering the expansion of a simply supported beam on a fixed base. As the temperature, for example, increases the axial stresses increase, since the beam wants to expand but is held fixed. As soon as a normal force is applied; the beam deflects further than normal due to an increased moment due to the internal stress, or more descriptively the thermal force applied axially times the moment arm which is the normal displacement.

Figure 1:
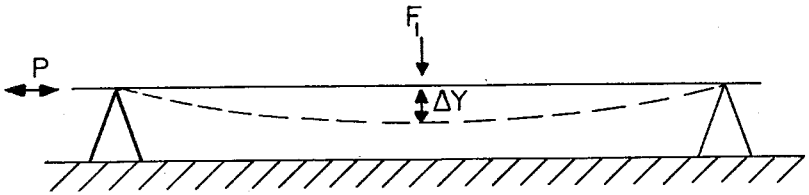
FIG. 1 illustrates a hypothetical view of a simply supported beam.

FIG. 1 shows a schematic.

The thermal force P is readily expressed as $$P = A_b\,E\,\alpha_T\,\Delta T$$

where $A_b$ is the cross section of the beam, $E$ is Young Modulus, $\alpha_T$ is the coefficient of expansion of the beam relative to the fixed body and $\Delta T$ is the temperature change from the unstressed condition.

The displacement $\Delta y$ due to the normal force then simply becomes $$\Delta y = \frac{FL^3}{48E\left(I - \frac{PL^2}{12E}\right)}$$

where $I$ is the beam moment of inertia and $L$ its length. (The above is referenced to Marks Standard Handbook for Mechanical Engineers, pp. 5-29 to 5-55).

Defining the spring constant K as $$K = \frac{dF}{d(\Delta y)}$$

then $$K = \frac{48E\,(I - PL^2/12E)}{L^3}$$

or $$K = \frac{48EI}{L^3}\left(1 - \frac{A_b\alpha_T L^2}{12I}\cdot\Delta T\right)$$

The spring constant is now temperature dependent. Consider now a linearized range of viscosity with temperature so that $$\mu = \mu_o\,(1 - \beta\mu\ \Delta T)$$

Typically for MIL-H-5606, $\beta\mu = 0.015$ 1/° F at 80° F. By defining the metal thermal coefficient $$\beta_M = \frac{A_b\alpha_T L^2}{12I}$$

and noting that for a typical value of $\alpha_T = 1.5 \times 10^{-5}$ 1/° F of the ratio $$\frac{\mu}{K} = \mu_o \frac{(1 - \beta_\mu \Delta T)}{\frac{48EI}{L^3}\,(1 - \beta_M \Delta T)}$$

will become temperature independent when $\beta\mu = \beta_M$. If one sets $I = bd^3/_{12}$ (for a rectangular beam)

$$\beta_M = \left(\frac{L}{d}\right)^2 \alpha_T$$

hence for $\beta_M = \beta\mu$ and $\alpha_T = 1.5 \times 10^{-5}$, $d = 31.6$. Thus a spring loaded piston/cylinder capacitor with a spring made of a simply supported beam in a non-expanding body with the above criteria will give an RC time constant independent of temperature over the temperature range where the viscosity is linear.

Figure 2:
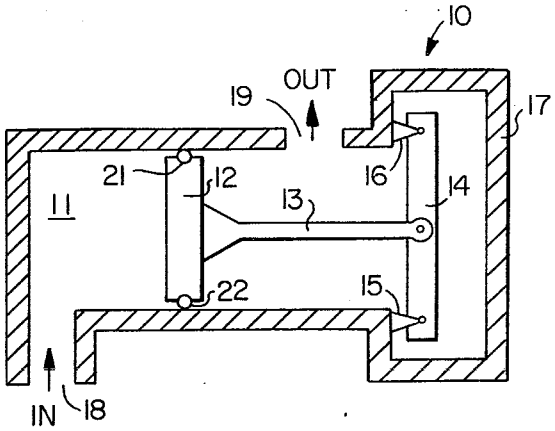
FIG. 2 illustrates a cross sectional view of one embodiment of the present invention.

Referring now to the preferred embodiment illustrated in FIG. 2, the capacitor is indicated generally at 10 and comprises a fluid chamber 11 into which fluid is allowed to enter by means of entrance port 18. The action of the fluid upon the surface of piston 12 causes a force to be transmitted through connecting rod 13 to the center of flexible beam 14. Beam 14 comprises a high thermal expansion material such as aluminum, for example, and is held rigidly in place by supports 15 and 16 and by external frame 17 which is made of a low thermal expansion material such as cast iron. Beam 14 rigidly held in place by supports 15 and 16 and frame 17 approximates the idealized situation illustrated in FIG. 1.

Fluid within chamber 11 is sealed from the opposite exit side by "O" rings 21 and 22. Displacement of the piston 12 forces fluid to exit the chamber by way of exit port 19. It is apparent from the foregoing that a new, novel and unobvious fluidic capacitor has been invented. It should be understood, however, that the inventor does not desire to be limited to the exact details of construction shown and described, because obvious modifications can be made by a person skilled in the art.

I claim as my invention:

1. A fluidic capacitor for liquid use comprising:

a. a chamber for receiving fluid into said capacitor;

b. a piston comprising one wall of said chamber;

c. a flexible beam supported at both ends thereof by a rigid frame, said frame being fixed relative to said chamber;

d. a connecting rod for transmitting fluid forces acting on said piston into normal forces acting on the center of said beam, the centerline of said connecting rod intersecting the centerline of said beam; and e. means for permitting entrance and exit of said fluid to and from said chamber.

2. The invention defined in claim 1 wherein said flexible beam comprises a high thermal expansion material.

3. The invention defined in claim 2 wherein said rigid frame comprises a low thermal expansion material.

4. The invention defined in claim 3 wherein the deflection of said beam is a function of both temperature and applied force.

5. The invention defined in claim 4 wherein said piston is slidable within said chamber.

6. The invention defined in claim 5 wherein said fluid is permitted to exit due to displacement of said piston.

7. A fluidic capacitor for liquid comprising:

a. a chamber having a port for placing said chamber in fluid communication with a working fluid;

b. a piston forming one wall of said chamber;

c. a rigid frame attached to the other walls of said chamber;

d. a flexible beam irrotatably supported at both ends thereof by said rigid frame;

e. means for maintaining said flexible beam at the temperature of said working fluid; and f. connecting means for transmitting fluid forces acting on said piston into normal forces acting on the center of said beam;

whereby the capacitance varies as the inverse of the working fluid viscosity.

8. The invention defined in claim 7 wherein said flexible beam comprises a material having a thermal expansion rate high relative to the thermal expansion rate of said rigid frame.

9. The invention of claim 8 wherein said piston is slidable within said chamber.

* * * * *